United States Patent [19]

Piguet

[11] 4,385,291

[45] May 24, 1983

[54] ELECTRONIC DIARY WATCH

[75] Inventor: Christian Piguet, Neuchâtel, Switzerland

[73] Assignee: Centre Electronique Horloger SA, Neuchâtel, Switzerland

[21] Appl. No.: 177,697

[22] Filed: Aug. 12, 1980

[30] Foreign Application Priority Data

Aug. 13, 1979 [CH] Switzerland ..... 7398/79

[51] Int. Cl.[3] ..... G09G 3/00

[52] U.S. Cl. ..... 340/712; 340/365 VL; 364/706; 368/10; 368/41

[58] Field of Search ..... 340/711, 712, 365 C, 340/365 VL, 751; 364/706, 705, 710; 368/10, 41, 42, 43; 400/108–112

[56] References Cited

U.S. PATENT DOCUMENTS

| | | | |
|---|---|---|---|
| 3,757,037 | 9/1973 | Bialek | 340/711 |
| 3,879,722 | 4/1975 | Knowlton | 340/711 |
| 3,999,050 | 12/1976 | Pitroda | 368/10 |
| 4,193,119 | 3/1980 | Arase et al. | 340/751 |
| 4,222,615 | 9/1980 | Penz | 340/365 C |
| 4,257,117 | 3/1981 | Besson | 340/365 C |
| 4,274,146 | 6/1981 | Yanagawa | 364/710 |

*Primary Examiner*—Marshall M. Curtis

*Attorney, Agent, or Firm*—Wender, Murase & White

[57] ABSTRACT

The data input device permits the selection of a symbol amongst a set of N symbols, e.g. for memorizing a message. A data input device permitting selection of a particular symbol from amongst a set of N symbols includes a display subdivided into K distinct display zones and K selecting elements, each K selecting element being associated with a specific one of the K distinct display zones. The device may be used, for example, in an electronic diary watch to select alphanumeric symbols and thereby record a message for use in the diary mode of operation. A microprocessor connected to the display and selecting elements first causes the set of N symbols to be divided and displayed equally among the K distinct display zones upon manual actuation of a data selection switch. Subsequently, manual actuation of one of the K selecting elements causes the microprocessor to select the symbols of the distinct display zone associated with the actuated selecting element; these selected symbols are equally distributed and displayed among the K distinct display zones. This selecting process is repeated until the desired symbol is isolated and displayed in one of the K distinct zones, at which point manual actuation of the selecting element corresponding to that particular display zone causes the microprocessor to select and memorize that desired symbol. This selecting process is then repeated for each symbol of the message to be memorized.

3 Claims, 13 Drawing Figures

ELECTRONIC DIARY WATCH

BACKGROUND OF THE INVENTION

The present invention relates to a multifunction watch and in particular to an electronic diary watch provided with an improved data input device.

Recent developments in the electronic industry have rendered possible realization within a small volume complex multifunction electronic circuits. This is, for example, the case of electronic circuits for watches which, in addition to functions of time calculation and display, incorporate auxiliary functions primarily related to time calculation, such as chronometer functions, calendar functions and so on. It is desirable to add to the existing functions of a watch to a diary function for permitting the user to record messages associated with a given date and hour, to read the recorded messages and to get an automatic recall when the recorded data and hour of a message coincide with the actual date and hour of the watch.

Such a diary function is already known, for example, according to U.S. Pat. No. 3,999,050 which describes an electronic diary comprising a keyboard having one key per alphanumeric symbol and various keys related to different functions. Such a configuration requires a large number of keys and the time required to introduce a message for recording in the diary is relatively long. Moreover, the high number of keys requires a particular skill from the user to avoid actuating a wrong key.

An article published in the journal IEEE Spectrum of April 1977 with the title "Watch Module Permits User to Write a Five Word Message" describes a method for the introduction of alphabetical symbols which requires only two buttons. One of them controls the procession of the twenty six letters of the alphabet on a display and the other one permits introduction of the selected letter. The algorithm for the selection of the letters is sequential, as described in the U.S. Pat. No. 3,823,545. Such a method of introducing symbols is long and tedious if the number of possible symbols is high.

Another device for the selection of symbols is known from the U.S. Pat. No. 3,771,156 describes an apparatus for communication by handicapped persons. The apparatus has a display of sixty four symbols distributed in four zones. The sequential procession of a luminous pointer on each of the four zones permits the user to select with a pushbutton the zone comprising the desired symbol. The selection of a zone leads the procession of the pointer within that zone. The process is repeated until the desired symbol is selected. For each symbol the user must wait until the luminous pointer is on the zone comprising the desired symbol or on this symbol before to introduce the selected symbol. Such a selection of symbols is particularly time consuming.

SUMMARY OF THE INVENTION

It is therefore an object of the present invention to provide a data input device free of the above mentioned disadvantages.

Another object of the invention is to provide an electronic diary watch comprising an improved data input device.

It is another object of the invention is to provide an electronic diary watch comprising only a restricted number of control elements.

It is another object of the invention to provide an electronic diary watch particularly simple to utilize.

Another object of the invention is to provide an electronic diary watch comprising a microprocessor for the time functions as well as for the diary functions.

A data input device according to the present invention permits the selection of a symbol or a group of symbols from amongst a set of N symbols or groups of symbols, and it is characterized in that it comprises a display divided in K distinct zones, K selecting elements, each element being respectively associated to one of the K zones of the display, means for distributing the set of N symbols or groups of symbols on said K zones of the display when the data selection is activated, and in that the activation of one selecting element Ki leads, if there is only one symbol or group of symbols in the associated zone Ki to the selection of this symbol or group of symbols and, if there is a plurality of symbols or groups of symbols within said associated zone Ki, to the distribution of said plurality of symbols or groups of symbols on all or part of said K zones of the display for permitting a new selection.

BRIEF DESCRIPTION OF THE DRAWINGS

Other objects, features and advantages of the present invention will become apparent from a reading of the following description of an embodiment of the invention, said description being made purely for illustrative purpose and in conjunction with the accompanying drawings, wherein.

DESCRIPTION OF THE PREFERRED EMBODIMENT

Figure 1:
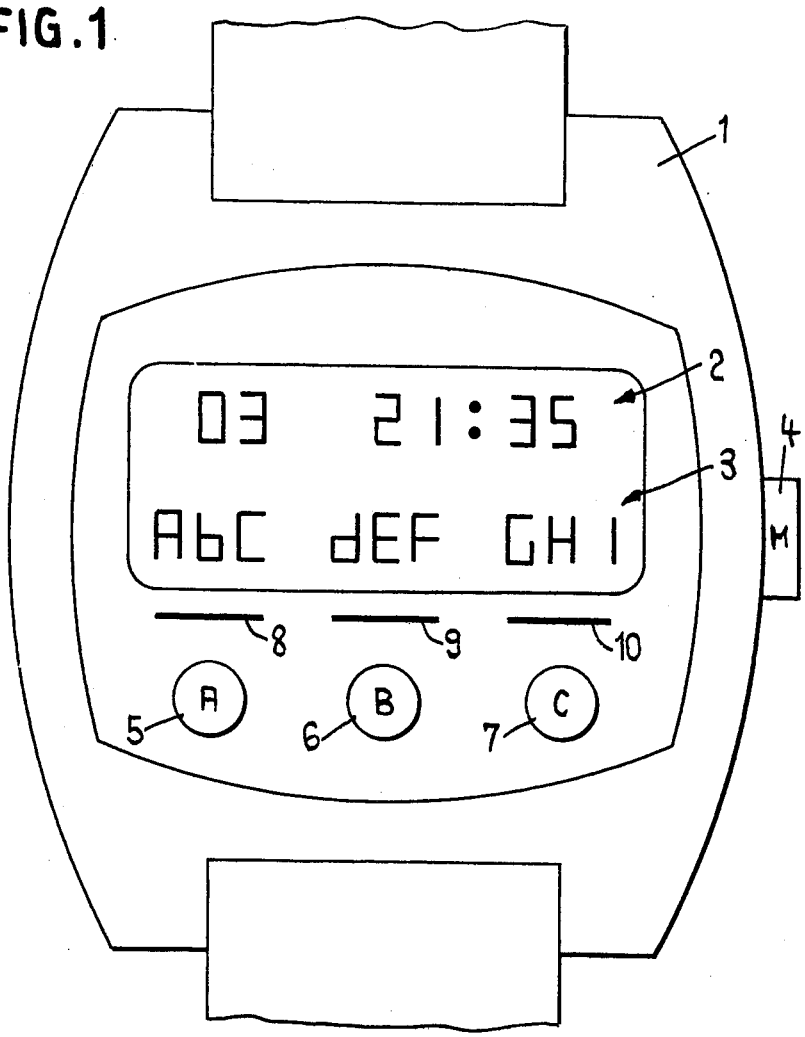
FIG. 1 is a top plan view of a watch provided with the device according to the present invention.

The watch illustrated in FIG. 1 comprises a case 1, a control element 4(M), e.g. a push-button, and a display. A characteristic of the watch is that it comprises two display fields indicated by 2 and 3 and that field 3 is subdivided into several zones (three zones in the case of FIG. 1) marked or delimited in the described example by the lines or bars 8, 9 and 10. Selecting elements 5(A), 6(B) and 7(C) are associated to the zones of the display which are delimited by the lines 8, 9 and 10, respectively. The lines 8, 9 and 10 may be engraved on the watch glass. The selecting elements 5, 6 and 7 may be capacitive, resistive or other types of transducers formed by electrodes deposited on the watch glass. It is also possible to utilize push-buttons. The display as illustrated corresponds to the mode of selection of the symbols. Field 2 is then utilized for displaying time information and field 3 for displaying a set of symbols in view of the selection of one of them as indicated hereafter.

Figure 2:
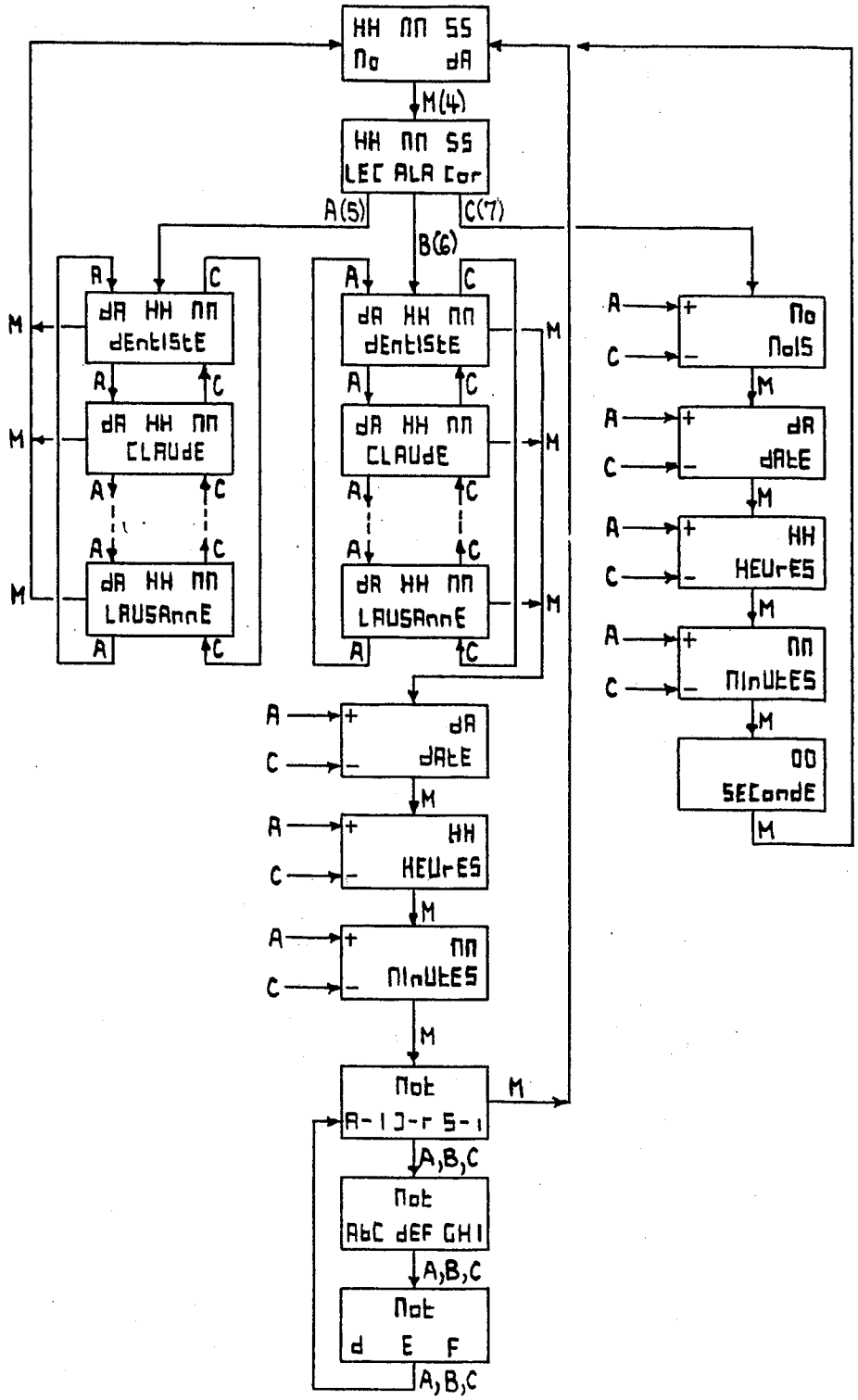
FIG. 2 is a flow chart illustrating the display of the watch of FIG. 1 as it is manipulated through various time-keeping and diary functions.

FIG. 2 shows the various functions (with french indications) of a diary watch and how to utilize these functions or how to pass from one function to another in a watch comprises a data input device according to the invention.

The various functions of the watch are:

calculation and display of the real time information, reading of the dates or of the recorded messages (function LEC), recording or correcting of the dates or of the messages (function ALA), and correcting of the time informations (function Cor).

As shown in FIG. 2, starting from the normal display of the time (hours,HH; minutes,MH; second,SS; months,Mo and date, dA) a pressure exerted on the push-button M causes the display on the field 3 of the set of the functions of the watch. The functions are designated by the indications LEC (reading), ALA (recording) and Cor (time correction).

Figure 3:
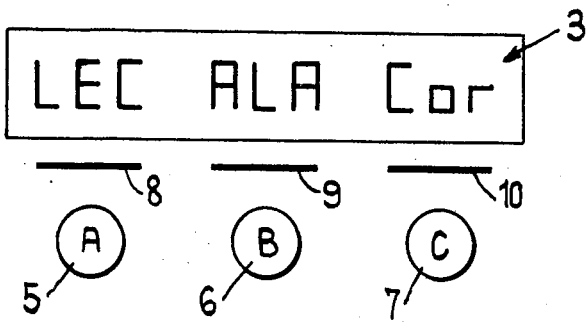
FIG. 3 is a top plan view of a portion of the watch of FIG. 1 illustrating selection of a function.

As shown in FIG. 3, the activation of one of the selecting elements A, B or C associated, respectively to the bars 8, 9 and 10 permits the selection of one of the functions. The function LEC (reading), selected by the activation of the selecting element A permits to read sequentially the various messages memorized in the watch. The display shows in the field 3 the nature of the dates or messages and in the field 2 the associated time informations such as date, hour and minute. The activation of the selecting element A permits the forward procession of these dates or messages and the activation of the selecting element C the backward procession of these dates. A pressure on the push-button M sets the watch in its normal mode of operation (time indication).

The function ALA (recording) is utilized to record a new message. The activation of the selecting element B permits the reading of the various memorized messages in order to select the one which must be modified. Like in the preceding case, the selecting element A controls the forward procession and the selecting element C the backward procession of these messages. When the message to be modified is selected, successive pressures exerted on the push-button M permit to increment with the selecting element A or to decrement with the selecting element C respectively the minute, the hour and the date of the associated information of the time of alarm. FIG. 2 shows that any risk of error is avoided because each unit of time to be corrected and which is displayed in field 2 is identified by its name in field 3. After having corrected the date, a further pressure exerted on M permits the correction of the word designating the nature of the message to be modified. This word may be the name of a person, the designation of a place or any other designation capable to characterize the nature of an information or of an appointment. The new word is composed letter by letter, these letters being selected within an alphabet by means of the selecting elements A, B and C and by using the data input device according to the invention.

Figure 4:
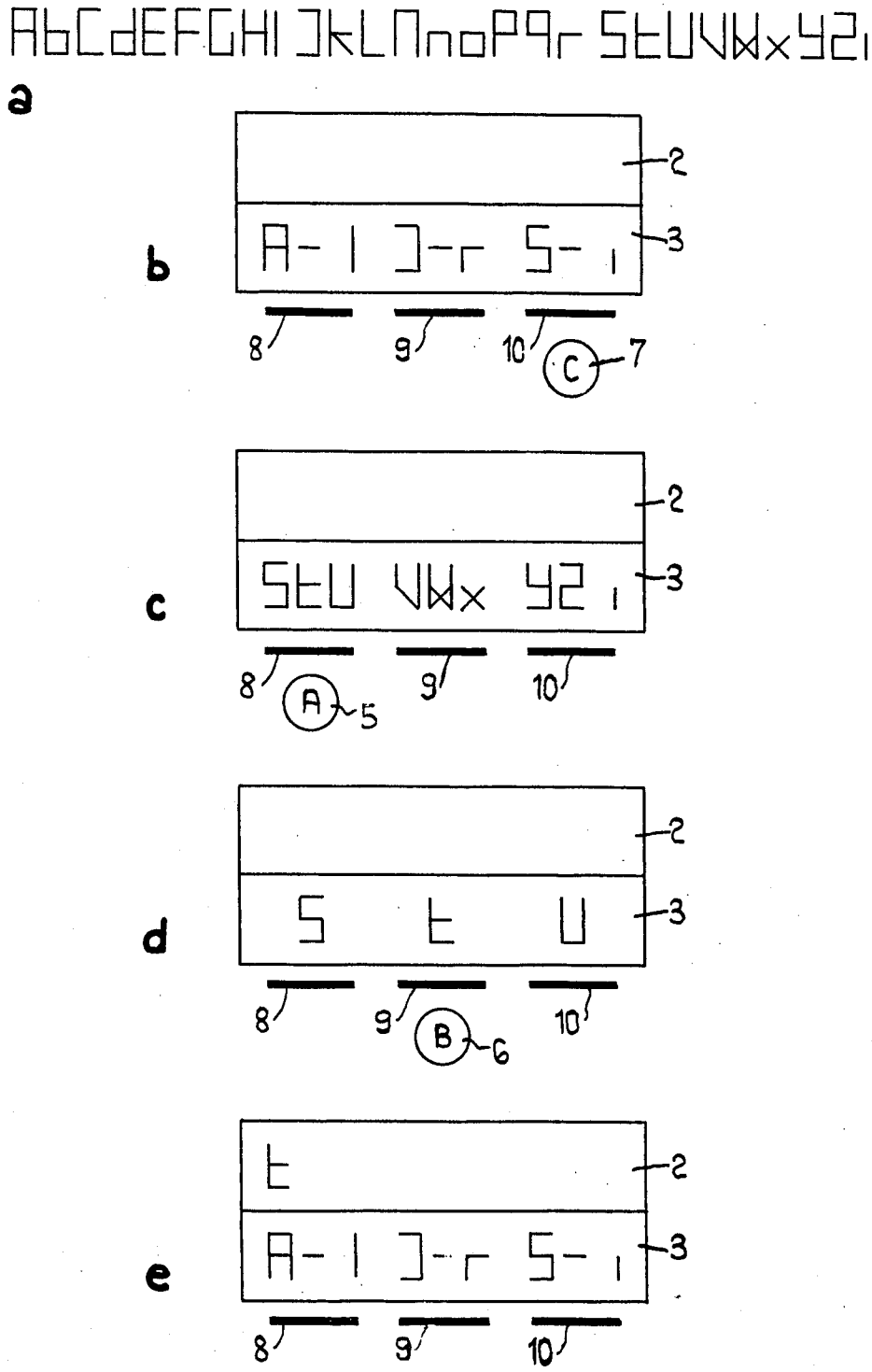
FIG. 4 illustrates the display, selecting elements and alphanumeric symbols of the watch of FIG. 1 in selecting one symbol from amongst a set of 27 symbols.

FIG. 4 shows by means of an example the principle of the selection of a symbol from an alphabet which may be alphanumeric and comprising N symbols. In the particular case of FIG. 4, the alphabet includes the N=27 symbols indicated in FIG. 4*a*. At the beginning of the selecting operation these symbols are displayed in field 3 of the double display as indicated in FIG. 4*b*. In FIG. 4*b* the 27 symbols are distributed in three groups of 9 symbols each, each group being designated and delimited by one of the bars or lines 8, 9 and 10 associated respectively to the selecting elements A, B and C. The first group or zone comprises the symbols A, b, C, d, E, F, G, H, I represented schematically and in order to simplify by A-I in FIG. 4*b*. The second zone comprises the symbols J, k, L, M, n, o, P, Q, r represented by J-r and the third zone comprises the symbols S, t, U, V, W, x, Y, Z, , represented by S-,. Let us see now, by way of example, how the symbol t is selected. This symbol is comprised in the third zone S-, marked by the bar 10. The activation of the element C corresponding to that bar causes the selection of the third zone and its display in field 3 in place of the whole alphabet, as indicated in FIG. 4*c*. It is to be seen that the 9 symbols of the third zone are equally distributed on the whole length of field 3 of the display. FIG. 4*c* shows that the letter t to be selected is comprised in the first zone comprising the symbols S, t, U and marked by the bar 8. The activation of the element A permits to select that first zone and to display the three letters from which it is composed in field 3, as shown in FIG. 4*d*. The three letters S, t, U are equally distributed on the whole length of field 3 of the double display. Finally, the activation of the selecting element B (FIG. 4*d*) selects the desired letter t and displays it as the first letter of a word to be written in field 2 of the display, as shown in FIG. 4*e*. Field 3 displays again the 27 symbols of the alphabet in order to enable the user to select the next letter. The different symbols constituting the message are successively selected in the manner indicated above. When the whole message has written in field 2, a pressure exerted on the push-button M causes its recording in the memory of the watch and the latter is returned in its normal, time indicating mode of operation.

The function Cor (time correction) is selected by the activation of the selecting element C. It is intended for correcting the months, dates, hours and minutes by successive pressures exerted on the push-button M, the seconds being simultaneously set to zero. A pressure on M, at the instant of a time signal sets then the watch into working at the exact time. Like in the preceding case, the element A permits to increment and the element C to decrement the units of time indicated above and displayed in field 2 while the name of the displayed unit is written in field 3 of the double display in order to avoid any risk of error. It is to be seen that every operation, such as:

selection of a function, reading of a message, correction of the months, dates, hours and minutes, selection of symbols, is efficiently effected by means of the same four control elements M(4), A(5), B(6) and C(7).

Figure 5:
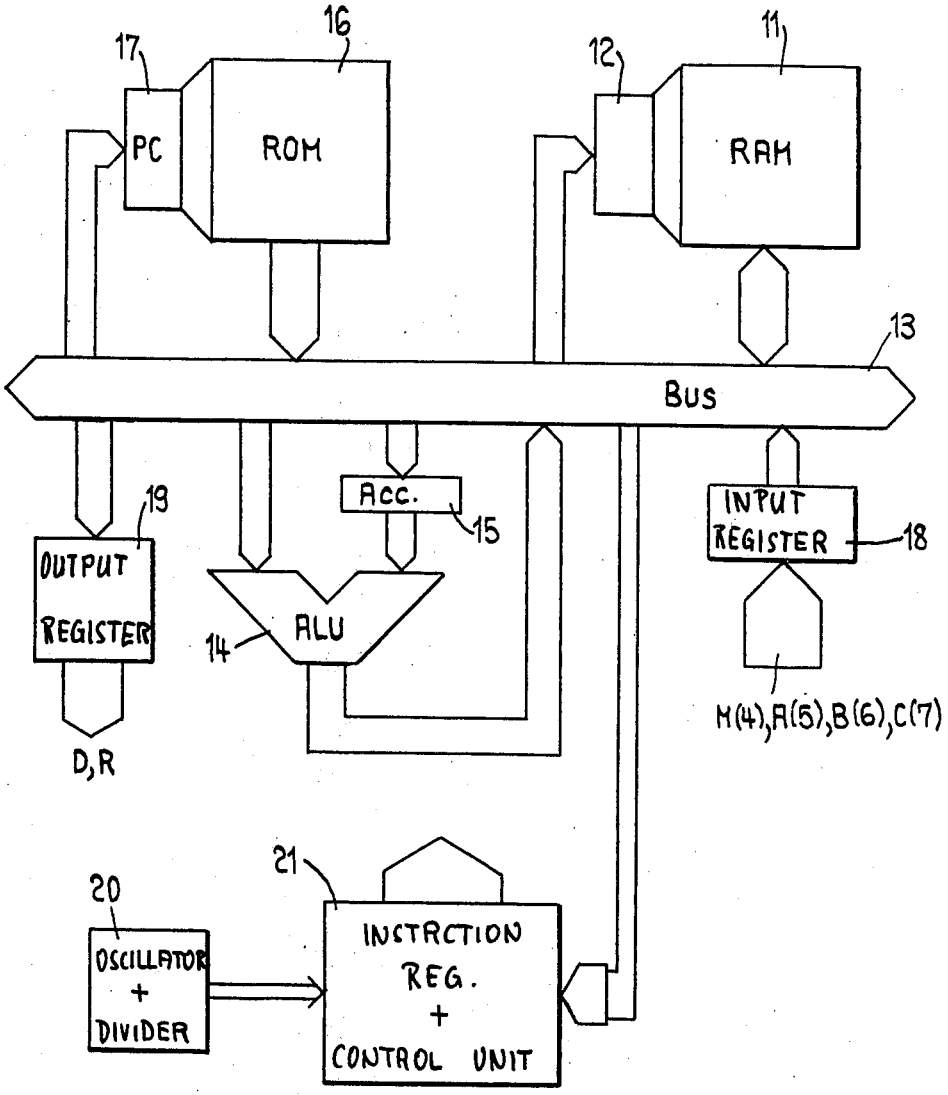
FIG. 5 is the block diagram of the circuit according to the present invention.

FIG. 5 shows the block diagram of a circuit which provides all the time and diary functions described above. The circuit is composed of:

a RAM (random access memory) 11 addressed by an address register 12 and containing the time information of the watch, the recorded messages and the operating registers of the circuit;

a ROM (read only memory) 16 addressed by the program counter 17 and containing the program;

an arithmetic and logic unit (ALU) 14 associated to an accumulator 15 for effecting the arithmetic and logic operations controlled by the program;

a control unit 21 receiving the clock signals of a time base 20 and sending to the different elements of the circuit the signals required for the execution of the instruction in progress.

An eight bit bus 13 connects the different elements of the circuit for permitting transfer of information between these elements. The circuit also includes an input register 18 connected to the control and selecting elements M, A, B and C of the diary watch and an output register 19 connected to the display unit and to an alarm device. The time base 20 comprises a known oscillator circuit which may be driven by a quartz crystal resonator and frequency divider stages capable of delivering amongst other signals of 2 kHz and 1 kHz. The 2 kHz signal determines the working frequency of the sequencer 21 and the 1 kHz signal is utilized for the calculation of the real time. A circuit or structure like the one described above has been presented to the "Congress International de Chronometrie" in Geneva, Switzerland, in September 1979 under the title "Conception d'un microprocesseur horloger". From the French published application 77 00138, a structure of a circuit for an electronic watch which could be utilized within the present invention instead of the above described circuit is taught.

Figure 7:
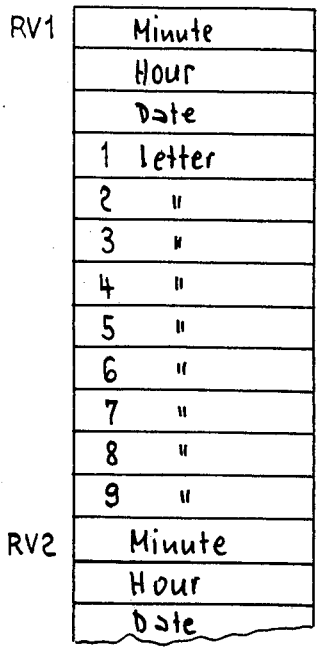
FIG. 7 shows how the data of a message is stacked in a RAM.
Figure 6:
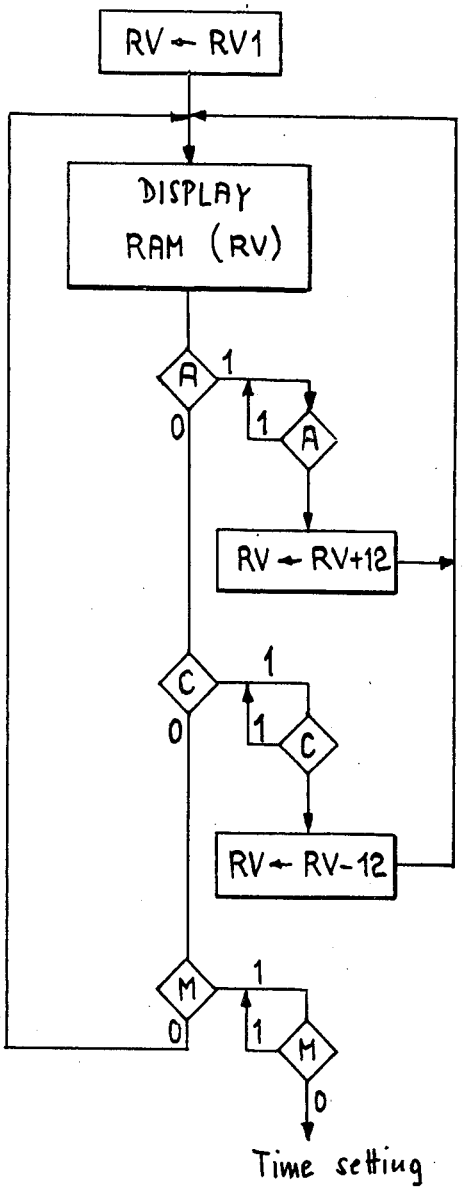
FIG. 6 is a flow chart illustrating the different operations to be effected for selecting the message to be corrected.
Figure 8:
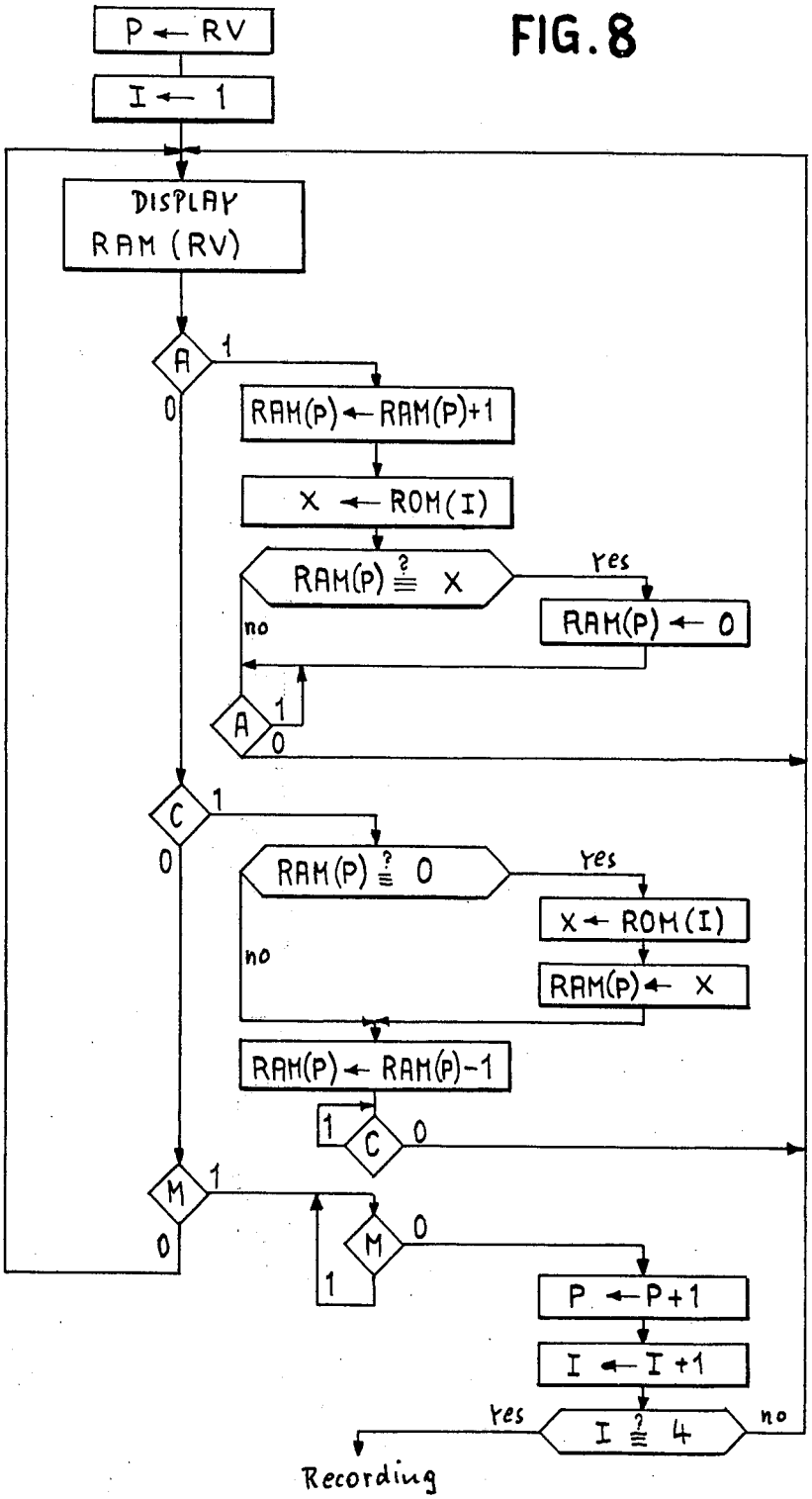
FIGS. 8 and 9 are flow charts illustrating the different operations effected, respectively, for correcting the memorized time informations of a message and for selecting the symbols of a word associated to this message.

The operation of the diary watch and more particularly the mechanism of data input will now be described with reference to FIGS. 6 to 9. As shown in FIG. 2, when the watch is in the normal mode of operation which corresponds to the display of the real time information, a pressure exerted on the push-button M causes the display of the functions LEC, ALA and Cor to occur and the activation of the selecting element B results in the selection of the mode "recording of messages". When this mode is selected, the operations schematically indicated in FIG. 6 are performed. The variable RV is initialized to the value RV1 which is the initial address in the RAM 11 of the first recorded message. FIG. 7 represents the part of the RAM 11 in which the informations of the different messages are recorded. Each message is associated to an initial address RV1, RV2, and so on. One message comprises the following informations arranged in the following order: Minute, hour, date and the codes of the first up to the ninth letter of the recorded word. The message corresponding to the initial address RV1 is then displayed on the double display of the watch and the state of the selecting element A is tested. If A is activated and then released (A=1 then A=0), the variable RV is incremented by 12 units and the next message is displayed. If C is activated and then released (C=1 then C=0), the variable RV is decremented of 12 units and the preceding message is displayed. The elements A and C thus enable the procession on the display of the different recorded messages in one direction, respectively in the other direction until the message to be corrected is displayed. A pressure exerted on the control element M (M=1 then M=0) causes the selection of the mode "time setting of the message". The operations which are performed in this mode of working of the watch are schematically shown in FIG. 8. The variable P is initialized to the value of RV and the variable I is initialized to 1. The different informations of the message having an initial address RV are then displayed. Each time the push-button M is actuated (M=1 then M=0) the two variables P and I are incremented by one unit. This permits the selection of the minutes, hours and dates in accordance with the following table 1:

TABLE 1

| P | I | ROM (I) | Information |
|---|---|---|---|
| RV | 1 | 60 | Minute |
| RV + 1 | 2 | 24 | Hour |
| RV + 2 | 3 | 31 | Date |

The value ROM(I) memorized in the memory 16 at the address I represents the limit value for each of the time informations (minute, hour, date). If I=4, these informations have been corrected and the recording phase is then executed. If the selecting element A is activated, the time information at the address corresponding to the variable P is incremented and then compared to the limit value addressed by the variable I and set to zero in the case of an identity. If the selecting element C is activated, the time information at the address corresponding to the variable P is compared with the value 0. In the case of an identity, the limit value at the address I is substituted to the time information and the latter in then decremented.

Figure 9:
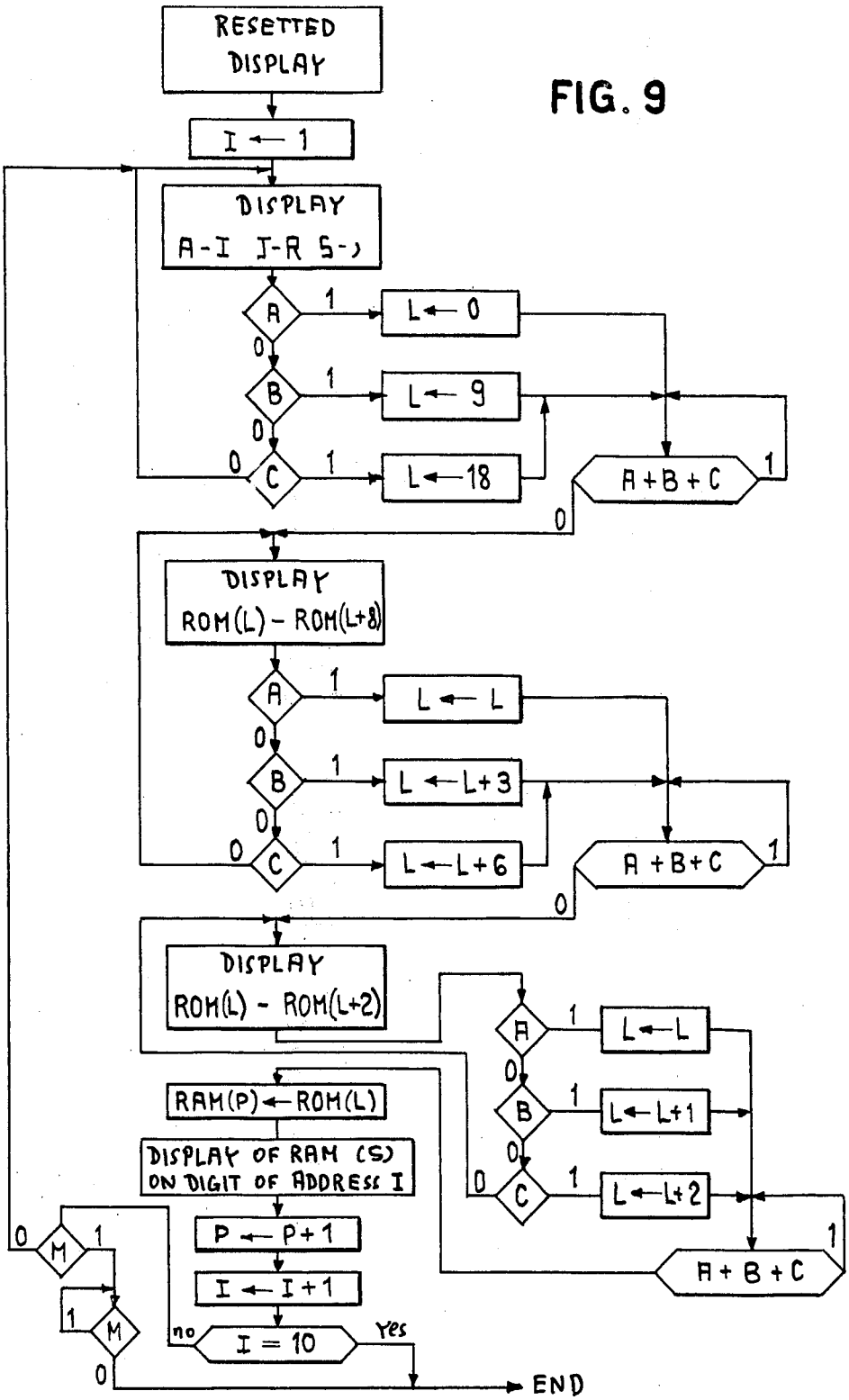

The operations which correspond to the recording of a word are represented schematically in FIG. 9. The following table 2 shows the different possible symbols which are comprised of the 26 letters of the alphabet plus the comma and their respective addresses in the ROM 16.

TABLE 2

| L | ROM (L) | L | ROM (L) | L | ROM (L) |
|---|---|---|---|---|---|
| 0 | A | 9 | J | 18 | S |
| 1 | B | 10 | K | 19 | T |
| 2 | C | 11 | L | 20 | U |
| 3 | D | 12 | M | 21 | V |
| 4 | E | 13 | N | 22 | W |
| 5 | F | 14 | O | 23 | X |
| 6 | G | 15 | P | 24 | Y |
| 7 | H | 16 | Q | 25 | Z |
| 8 | I | 17 | R | 26 | , |

It is clear that the symbols are stored in the ROM 16 in form of a code which will serve to control the display. After the display has been reset, the variable I is initialized to the value 1 and the set of the symbols is displayed as shown in FIG. 4*b*. The activation of one of the selecting elements A, B or C causes the variable L to take the value 0, 9 or 18 corresponding to the address of the first of the nine symbols of each group. The nine selected symbols ROM (L) to ROM (L+8) are then displayed as indicated in FIG. 4*c*. A further activation of one of the selecting elements A, B or C causes the incrementation of the variable L of 0, 3 or 6 units respectively, thus permitting the selection of three of the nine displayed symbols. The three selected symbols are then displayed as shown in FIG. 4*d*. The third activation of one of the selecting elements A, B or C causes the selection of the symbol corresponding to the address L, L+1 or L+2 respectively. The code of the selected symbol is then transferred into the RAM 11 at the address P, which means at the place corresponding to the first letter of the memory zone reserved for the message to be recorded. The selected symbol is also displayed on the digit corresponding to the address I of the field 2 of the double display as shown in FIG. 4*e*. The variables I and P are incremented so that the code of the next selected symbol is transferred to the next place in the memory zone (of the memory 11) and that said next selected symbol is displayed on the next digit of the field 2 of the display. The recording phase terminates if the push-button M is actuated or if nine symbols have been selected.

I claim:

1. An electronic diary watch with a data input device for selecting and displaying a number of alphanumeric symbols comprising:

a time base;

a display having a plurality of display fields, one of said display fields being subdivided into K distinct display zones;

K selecting elements, each one of said K selecting elements being associated with a corresponding one of said K distinct display zones, said number of K selecting elements and display zones being smaller than the number of said alphanumeric symbols; and microprocessor means coupled to said time base, to said display means and to said K selecting elements for:

(i) dividing said alphanumeric symbols into K approximately equal groups and displaying each of said groups in a respective one of said K display zones, (ii) dividing the group of alphanumeric symbols in a chosen one of said display zones into K approximately equal parts and displaying each part in a respective one of said K display zones in response to manual actuation of one said selecting element corresponding to said one chosen display zone, (iii) repeating step (ii) in response to repeated manual actuation of said selected elements until no more than a single alphanumeric symbol is displayed in each display zone, and (iv) transferring to memory the single alphanumeric symbol chosen by the next manual actuation of a corresponding selecting element and repeating step (i), thereby enabling a sequence of individual ones of a number of alphanumeric symbols to be selected and transferred to memory by using a relatively smaller number of selecting elements.

2. The invention as recited in claim 1 wherein said microprocessor means displays each of said symbols transferred to memory in another one of said display fields.

3. The invention as recited in claim 2 further including a switch coupled to said microprocessor means; and wherein said microprocessor means transfers the symbols in said another display field to memory in response to actuation of said switch.

* * * * *